US005085180A

United States Patent [19]

Torigai

[11] Patent Number: 5,085,180

[45] Date of Patent: Feb. 4, 1992

[54] CRANK CHAMBER STRUCTURE FOR TWO CYCLE INTERNAL COMBUSTION ENGINE

[75] Inventor: Katsumi Torigai, Hamamatsu, Japan

[73] Assignee: Sanshin Kogyo Kabushiki Kaisha, Hamamatsu, Japan

[21] Appl. No.: 615,979

[22] Filed: Nov. 20, 1990

[30] Foreign Application Priority Data

Nov. 22, 1989 [JP] Japan ..... 1-301906

[51] Int. Cl.[5] ..... F02B 25/14

[52] U.S. Cl. ..... 123/73 A; 123/73 PP

[58] Field of Search ..... 123/73 A, 73 V, 73 PP, 123/73 S

[56] References Cited

U.S. PATENT DOCUMENTS

| | | | |
|---|---|---|---|
| 3,014,471 | 12/1961 | Eiler | 123/73 A |
| 3,810,450 | 5/1974 | Woodhouse | 123/73 A |
| 4,178,887 | 12/1979 | Iida | 123/73 A |
| 4,266,514 | 5/1981 | Tyner | 123/73 A |
| 4,777,913 | 10/1988 | Staerzl et al. | 123/73 A |
| 4,779,581 | 10/1988 | Maier | 123/73 A |
| 4,947,807 | 8/1990 | Flaig et al. | 123/73 A |
| 4,967,704 | 11/1990 | Imaeda | 123/73 A |

FOREIGN PATENT DOCUMENTS

| | | | |
|---|---|---|---|
| 0159918 | 10/1982 | Japan | 123/73 A |

*Primary Examiner*—David A. Okonsky
*Attorney, Agent, or Firm*—Ernest A. Beutler

[57] ABSTRACT

A two cycle, crankcase compression internal combustion engine which has one or more individually sealed crank chambers defined by one or more crank webs and a transfer passage associated with each chamber formed within the crankshaft body and cylinder block to provide increased flow area for the fuel/air mixture between the induction system and each cylinder. An inner wall forming portion of the crankcase body is expanded outwardly around crank webs and has an inwardly extending member associated with each crank web. A groove is formed in each inwardly extending member and cooperates with each of the outwardly expanding areas to define each of the transfer passages.

8 Claims, 4 Drawing Sheets

CRANK CHAMBER STRUCTURE FOR TWO CYCLE INTERNAL COMBUSTION ENGINE

BACKGROUND OF THE INVENTION

This invention relates to a crank chamber structure for a two cycle internal combustion engine, and more particularly to an improved crank chamber structure and arrangement which provides increased fuel/air transfer capability between the induction system and the combustion chamber so as to improve the power output capability of the engine.

In some multi-cylinder two cycle, crankcase compression internal combustion engines, it is the practice to employ crank webs positioned within the crankcase chamber. These crank webs in connection with sealing members which extend around the crank webs and which are in contact with the cylinder block and the crankcase body serve to partition the crankcase chamber into a plurality of individual crank chambers, one for each cylinder. Although this type of arrangement provides airtight crank chambers wherein the precompression ratio can be increased to improve intake efficiency, it has also previously resulted in very narrowly formed passages in the crank chambers for transfer of the fuel/air mixture to the scavenge passages which makes it difficult to increase the intake quantity to increase engine output.

It is, therefore, a principal object of this invention to provide an improved crank chamber structure and arrangement for a two cycle internal combustion engine which includes an expanded fuel/air transfer passage extending from the intake passage of the induction system to the scavenge passage so that the intake quantity can be increased and wherein the primary compression ratio can be increased so as to increase the power output of the engine.

SUMMARY OF THE INVENTION

A first feature of this invention is adapted to be embodied in a two cycle, crankcase compression internal combustion engine having at least one combustion chamber. The engine comprises a crankcase assembly including an inner wall forming portion and a crankshaft rotatably journaled within the crankcase assembly. At least one crank web is positioned within the crankcase assembly and cooperates in defining at least one crank chamber within the crankcase assembly, and has a seal member extending around it which is in contact with the inner wall forming portion of the crankcase assembly. At least one intake passage is provided for delivering a charge to the crank chamber. In accordance with the invention, the inner wall forming portion is expanded outwardly around the crank chamber to define a transfer passage for communicating the intake passage with the combustion chamber.

Another feature of this invention is adapted to be embodied in a two cycle, crankcase compression internal combustion engine having a plurality of combustion chambers which comprises a crankcase assembly including an inner wall forming portion and a crankshaft rotatably journaled within the crankcase assembly. A plurality of crank webs are positioned within the crankcase assembly and cooperate in defining a plurality of crank chambers within the crankcase assembly. A plurality of seal members are provided which extend around the crank webs and are in contact with the inner wall forming portion of the crankcase assembly. A plurality of intake passages are provided for delivering a charge to the crank chambers. In accordance with the invention, the inner wall forming portion is expanded outwardly around the crank chambers to define a plurality of transfer passages for communicating the intake passages with the combustion chambers.

DETAILED DESCRIPTION OF THE PREFERRED EMBODIMENT OF THE INVENTION

Figure 1:
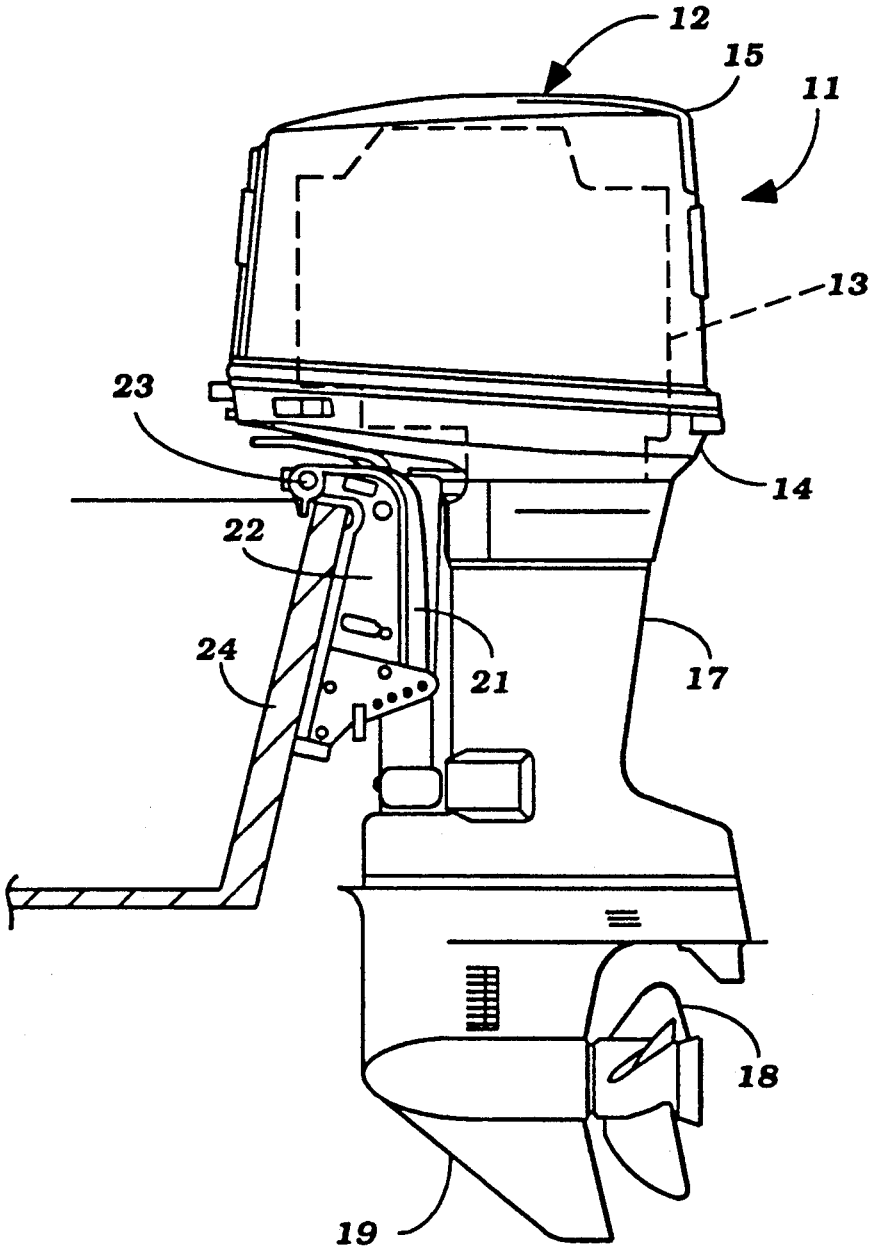
FIG. 1 is a side elevational view of an outboard motor constructed in accordance with an embodiment of the invention.

Referring first to FIG. 1, an outboard motor is depicted and is indicated generally by the reference numeral 11. The invention is described in conjunction with an outboard motor because this is a typical application for a two cycle, crankcase compression internal combustion engine. It is to be understood, however, that the invention can be utilized in conjunction with other applications for such engines.

The outboard motor includes a power head assembly, indicated generally by the reference numeral 12, which includes an internal combustion engine 13, of a type to be described, and a protective cowling comprised of a tray 14 and a main cover portion 15.

In the illustrated embodiment, the engine 13 is supported so that its crankshaft (to be described) rotates about a vertically extending axis because such an arrangement is typical in outboard motors. However, the invention can also be utilized in connection with an engine having a horizontally extending crankshaft. The crankshaft drives the driveshaft 16 (see FIG. 2) that is contained within a driveshaft housing 17 that depends from the power head 12. This driveshaft 16 drives a propeller 18 by means of a forward, neutral, reverse transmission of a known type which is incorporated within a lower unit 19 positioned beneath and affixed to the driveshaft housing 17.

A steering shaft (not shown) is affixed to the driveshaft housing 17 and is journaled for steering movement within a swivel bracket 21 for steering of the outboard motor 11. The swivel bracket 21 is, in turn, pivotally connected to a clamping bracket 22 by means of a tilt shaft 23 for tilt and trim movement of the outboard motor 11 in a known manner. The clamping bracket 22 is, in turn, adapted to be affixed to a transom 24 of an associated watercraft in a known manner.

The construction of the outboard motor 11 as thus far described may be considered conventional. Also, as noted, the invention relates to the engine 13 and specifically to its crank chamber structure. For that reason, details of the construction of the outboard motor 11 apart from the engine 13 are not believed to be necessary for one skilled in the art to understand the invention.

Figure 2:
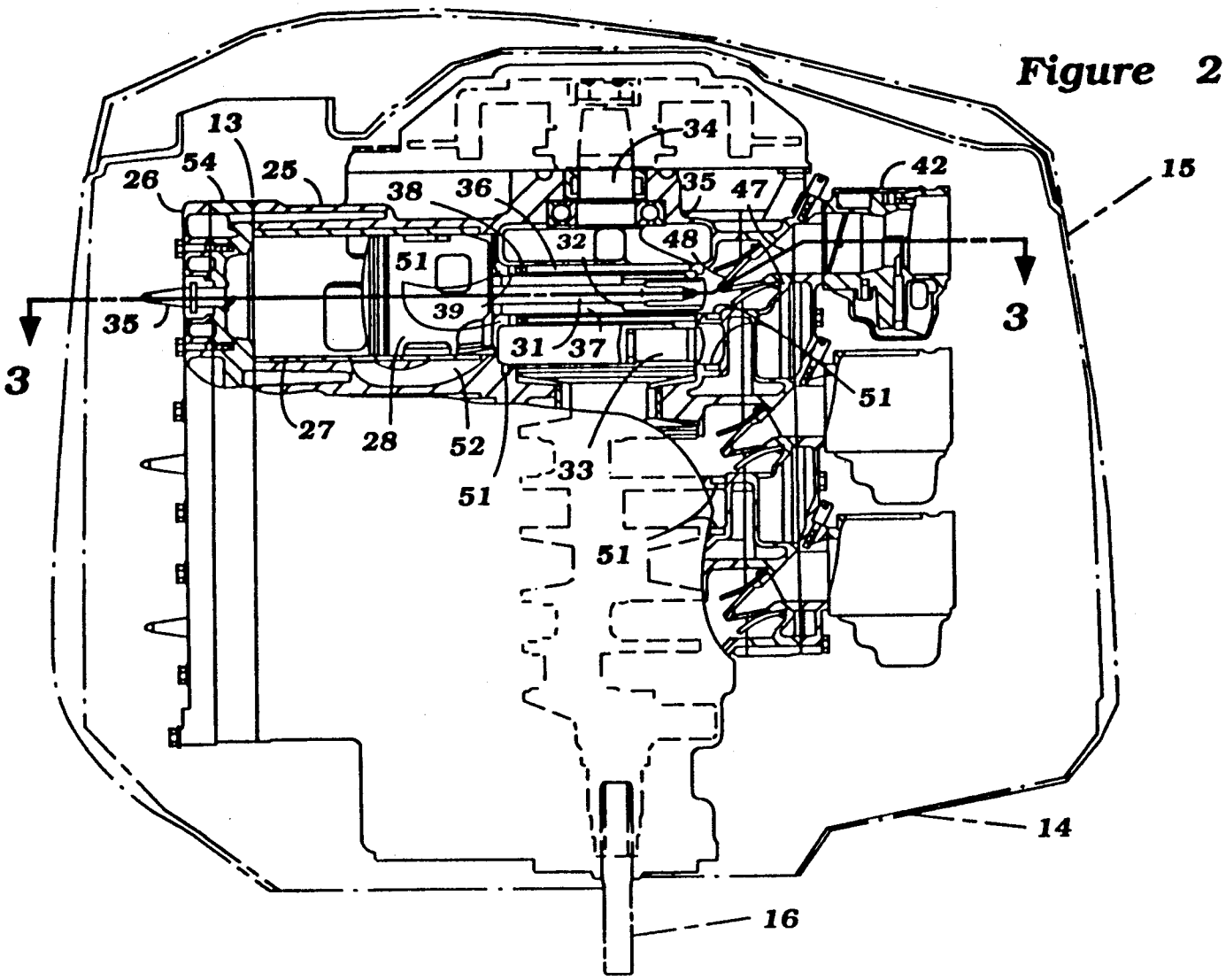
FIG. 2 is an enlarged side elevational view of the power head with the protective cowling shown in phantom and portions of the engine broken away.
Figure 3:
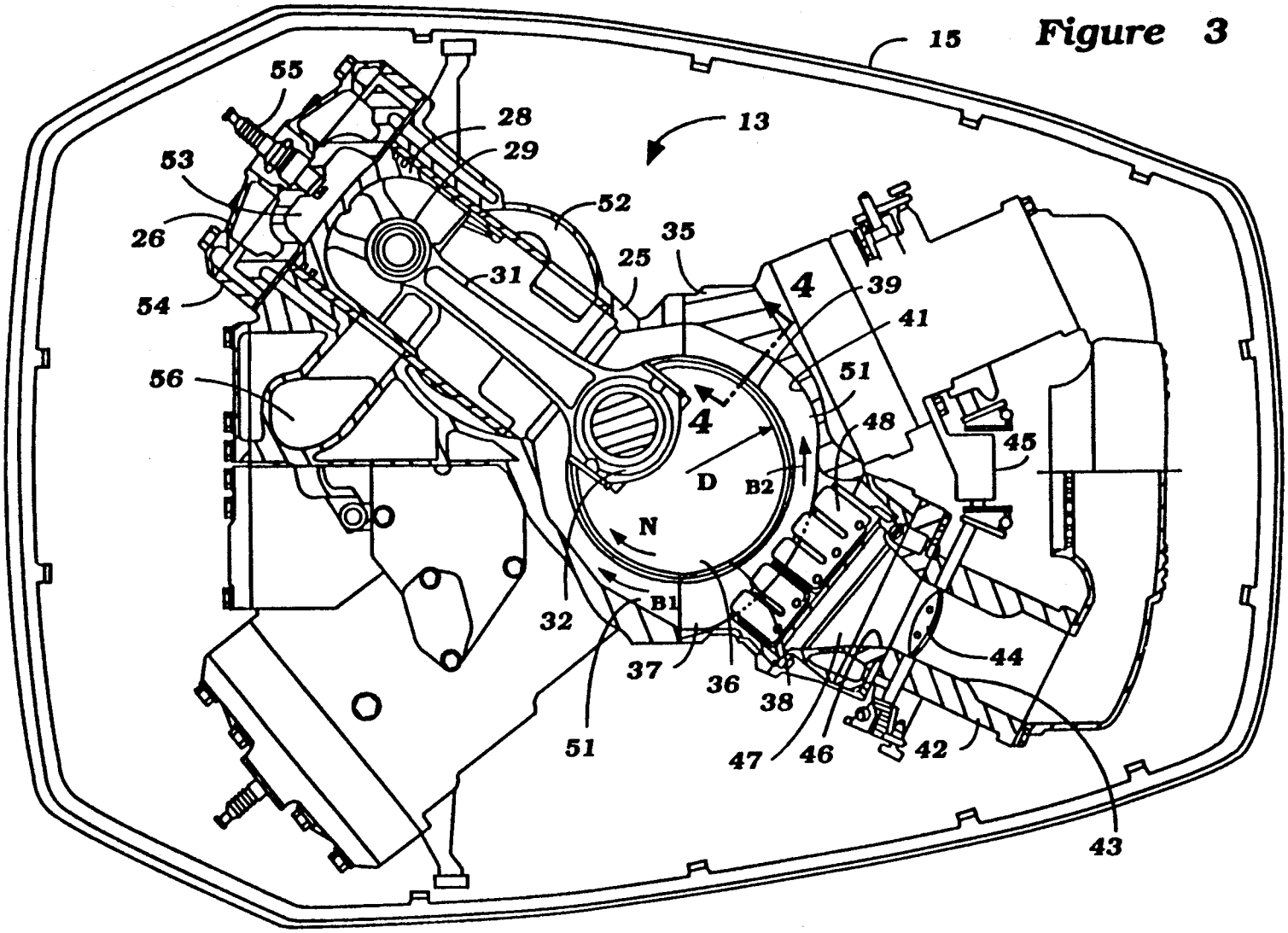
FIG. 3 is a cross sectional view taken along line III—III of FIG. 2.

Referring now in detail to the remaining figures and initially to FIGS. 2 and 3, the engine 13 is depicted as being of the V-6 type and thus has a cylinder block 25 which is provided with angularly disposed cylinder banks 26, each of which is provided with a cylinder bore 27. Although the invention is described in conjunction with a V-6 type engine, it is to be understood that the invention may be utilized with engines having a different number of cylinders or different cylinder configurations.

A piston 28 is slidably supported in each of the cylinder bores 27. Each piston 28 is connected to a small end portion 29 of a respective connecting rod 31. A big end portion 32 of each connecting rod 31 is, in turn, connected to individual throws 33 of a crankshaft 34 which, in the illustrated embodiment, rotates about a generally vertically extending axis. The crankshaft 34 is journaled for rotation within a crankcase assembly consisting of a crankcase body 35 and the cylinder block 25. In the illustrated embodiment, a plurality of crank webs 36 are positioned within the crankcase assembly and serve to divide it into individual crank chambers 37, one associated with each of the cylinder bores 27. A seal member 38 extends around each crank web 36 and has its outer surface in contact with an inwardly extending member 39 of an inner wall forming portion 41 of the crankcase body 35 to further seal the crank chambers 37. Alternatively, each crank web 36 and associated seal member 38 may be integrally formed with the crankcase assembly.

A fuel/air charge or mixture is delivered to these crank chambers 37 through an induction system which includes two pairs of three vertically disposed single barrel carburetors 42, one one for each crank chamber 37 associated with each cylinder bank 26. The carburetors 42 may be of any known type and are provided with intake passages 43. The carburetors 42 draw an intake charge through an intake device which, in turn, draws atmospheric air into the protective cowling. The carburetors 42 each have throttle valves 44 for controlling the flow therethrough and which are operated by a common linkage system 45 provided in the area between the carburetors 42.

Pairs of reed valve blocks and mainfolds and spacer plates are interposed between the carburetors 42 and the crank chambers 37. The plates are provided with passages 46 that generally expand the flow area and which mate with corresponding intake passages 47 formed in the valve blocks. Reed valve assemblies 48 having a generally V shaped configuration extend across these intake passages 47 at an angle to the intake passages 43 of the carburetors 42 and generally in perpendicular relationship to an extension of the axis of the cylinder bores 27 of the cylinder banks 26 which they serve. Therefore, the reed valves 48 extend generally in a tangential direction to the crank chambers 37 so there will be good induction efficiency. Also, a relatively large area for the reed valves 48 is possible due to this orientation.

Figure 4:
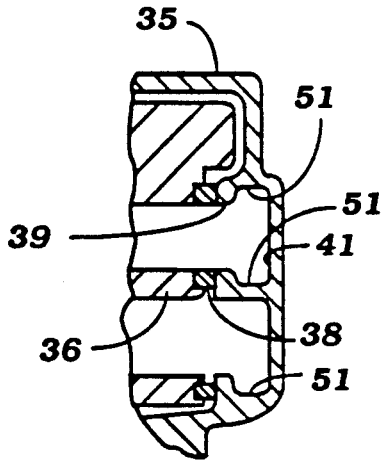
FIG. 4 is a cross sectional view taken along line IV—IV of FIG. 3.

The fuel/air mixture is then delivered into the crank chambers 37 where it is compressed. In accordance with the invention, the inner wall forming portion 41 of the crankcase body 35 is expanded outwardly from the outer diameter D of each crank web 36 (see FIG. 3). As shown in FIGS. 2, 3 and 4, grooves 51 are formed in the inwardly extending members 39 and extend around the crankshaft 34 through the crankcase body 35 and cylinder block 25. These grooves 51 cooperate with the outwardly expanded portions of the inner wall forming portion 41 to provide increased flow area and to form expanded transfer passages for the fuel/air mixture between the intake passages 47 and scavenge passages 52.

These scavenge passages 52 communicate with combustion chambers 53 formed by the pistons 28, cylinder bores 27 and cylinder heads 54 which are affixed to each of the cylinder banks 26 in a known manner. This fuel/air mixture is then fired in the combustion chambers 53 by means of spark plugs 55. The expanding gases drive the pistons 28 as is well known and then are discharged through exhaust ports 56 formed in the cylinder banks 26 in the V of the engine 13.

It should be readily apparent from the foregoing description that a highly effective crank chamber structure and arrangement has been provided for a two cycle crankcase compression engine which provides increased flow area within the crank chambers 37 between the intake passages 47 and the scavenge passages 52, allowing a greater quantity of charge to be supplied to the combustion chambers 53 to increase power output and engine performance.

It is to be understood that the foregoing description is that of a preferred embodiment of the invention and that various changes and modifications may be made without departing from the spirit and scope of the invention, as defined by the appended claims.

I claim:

1. A two cycle, crankcase compression internal combustion engine having at least one combustion chamber, comprising a crankcase assembly including an inner wall forming portion, a crankshaft rotatably journaled within said crankcase assembly, at least one crank web positioned within said crankcase assembly and which cooperates in defining at least one crank chamber within said crankcase assembly, at least one intake passage for delivering a charge to said crank chamber, and wherein said inner wall forming portion includes an inwardly extending member having a groove formed therein on at least one side of a line segment extending between said intake passage and the axis of said combination chamber, said groove being expanded axially from at least one side of said inwardly extending member and expanded outwardly around said crank chamber to cooperate in defining a transfer passage for communicating said intake passage with said combustion chamber.

2. A two-cycle, crankcase compression internal combustion engine as recited in claim 1, further comprising at least one seal member positioned radially inwardly from the groove and extending around said crank web and wherein said inwardly extending member is in contact with said seal member.

3. A two cycle, crankcase compression internal combustion engine having a combustion chamber, comprising a crankcase assembly including an inner wall forming portion, a crankshaft rotatably journaled within said crankcase assembly a pair of crank webs positioned within said crankcase assembly and which cooperate in defining a crank chamber within said crankcase assembly, a seal member extending around one of said crank webs and in contact with said inner wall forming portion of said crankcase assembly, an intake passage for delivering a charge to said crank chamber, and wherein said inner wall forming portion includes an inwardly extending member having a groove formed therein expanded axially from at least one side of said inwardly extending member and expanded outwardly around said crank chamber to cooperate in defining a transfer passage for communicating said intake passage with said combustion chamber.

4. A two cycle, crankcase compression internal combustion engine as recited in claim 3, further comprising another seal chamber extending around the other of said crank webs and in contact with said inner wall forming portion of said crankcase assembly, and wherein said inner wall forming portion includes a second inwardly extending member having a groove formed therein expanded axially from at least one side of said second inwardly extending member and expanded outwardly around said crank chamber to cooperate in defining a second transfer passage for communicating said intake passage with said combustion chamber.

5. A two cycle, crankcase compression internal combustion engine as recited in claim 3, wherein said inwardly extending member is in contact with said seal member.

6. A two cycle, crankcase compression internal combustion engine as recited in claim 4, wherein each of said inwardly extending members is in contact with one of said seal member.

7. A two cycle, crankcase compression internal combustion engine having a plurality of combustion chambers, comprising a crankcase assembly including an inner wall forming portion a crankshaft rotatably journaled within said crankcase assembly, a plurality of crank webs positioned within said crankcase assembly and which cooperate in defining a plurality of crank chambers within said crankcase assembly, a plurality of seal members extending around said crank webs and in contact with said inner wall forming portion of said crankcase assembly, a plurality of intake passages for delivering a charge to said crank chambers, and wherein said inner wall forming portion includes a plurality of inwardly extending members each having at least one groove formed therein expanded axially from at least one side of its associated inwardly extending member and expanded outwardly around one of said crank chambers to cooperate in defining a plurality of transfer passages for communicating said intake passages with said combustion chambers.

8. A two cycle, crankcase compression internal combustion engine as recited in claim 7, wherein each of said plurality of inwardly extending members is in contact with one of said seal members.

* * * * *

UNITED STATES PATENT AND TRADEMARK OFFICE

CERTIFICATE OF CORRECTION

PATENT NO. : 5,085,180

DATED : February 4, 1992

INVENTOR(S) : Katsumi Torigai

It is certified that error appears in the above-identified patent and that said Letters Patent is hereby corrected as shown below:

Column 4, lines 39-40, Claim 1, "combination" should be --combustion--.

Column 4, line 57, Claim 3, after "assembly" insert --,--.

Column 5, line 5, Claim 4, "chamber" should be --member--.

Column 5, line 22, Claim 6, "member" should be --members--.

Column 6, line 2, Claim 7, after "portion" insert --,--.

Signed and Sealed this

Thirty-first Day of August, 1993

*Attest:*

Bruce Lehman

BRUCE LEHMAN

*Attesting Officer*

*Commissioner of Patents and Trademarks*